United States Patent [19]

Seber

[11] Patent Number: 4,821,933

[45] Date of Patent: Apr. 18, 1989

[54] LEATHER TAPE RULE HOLDER

[75] Inventor: Brett P. Seber, Laguna Niguel, Calif.

[73] Assignee: McGuire-Nicholas Company, Inc., City of Commerce, Calif.

[21] Appl. No.: 182,859

[22] Filed: Apr. 18, 1988

[51] Int. Cl.[4] ..... B25B 29/100

[52] U.S. Cl. ..... 224/248; 224/904

[58] Field of Search ..... 224/191, 226, 242, 245, 224/246, 249, 250, 251, 253, 904, 223, 240; 206/372, 373, 376, 377; 150/127, 128

[56] References Cited

U.S. PATENT DOCUMENTS

| | | | |
|---|---|---|---|
| 3,044,673 | 7/1962 | Manning | 224/245 |
| 3,128,926 | 5/1964 | Stella | 224/251 |
| 3,294,298 | 11/1966 | Danielson | 224/253 |
| 4,307,825 | 12/1981 | Pattermann | 224/904 |
| 4,598,027 | 7/1986 | Johnson | 224/904 |

*Primary Examiner*—Henry J. Recla

*Assistant Examiner*—Glenn Barrett

*Attorney, Agent, or Firm*—Philip D. Junkins

[57] ABSTRACT

A tape rule holder formed from two die cut flat pieces of heavy duty, top grain saddle leather. The back piece includes belt slots in its upper section. The front piece or pocket-forming member is configured in its flat pre-assembly form with peripheral side rivet areas and a bottom rivet area each defined by a fold line. Approximately mid-way of each side rivet area of the front piece is a "v" notch. Upon rivet assembly of the front pocket-forming piece to the back piece, with the front piece bowed outwardly to form a tape rule pocket and the "v" notches of the side rivet areas closed, the resulting tape rule pocket includes side walls using inwardly projecting pressure detent ridges which together grip a tape rule inserted into the pocket of the holder and maintain the tape rule therein against accidental dislodgement.

4 Claims, 1 Drawing Sheet

LEATHER TAPE RULE HOLDER

BACKGROUND OF THE INVENTION

The present invention relates to tape rule holders of the type used by carpenters, plumbers, electricians and other construction and repair workers. Commonly, these types of workers use, at frequent times during their work days, heavy-duty tape rules of one inch or greater thickness carrying 25 or more feet of metallic measuring tape which is spring-wound within a metal tape rule case. Also, it is common practice for such workers and others to carry encased tape rules in a leather holder having belt slots so that the holder (along with other types of tool holders) may be mounted on a rugged waist-spanning belt.

In most instances in the past, tape rule holders have been fabricated from heavy duty, top grain saddle leather with a front leather pocket-forming piece first die cut and die molded into pocket shape and thereafter double-riveted to a leather back piece having a pair of belt slots in its upper portion. Such tape rule holders have also included a safety strap, spanning the top pocket opening, for maintaining the encased tape rule in its seated position within the holder pocket when the tape rule is not in use by the worker thereby avoiding inadvertent loss or misplacement of the tape rule.

It is an object of the present invention to provide a leather tape rule holder, for mounting to a worker's belt, which includes in its pocket configuration side detent ridges which firmly and safely maintain a metal encased tape rule within such pocket without the need for a top safety strap.

It is a further object of the invention to provide a leather tape rule holder formed of front and back die cut flat leather pieces with the front piece being configured so that upon riveting its side and bottom edge areas to the side and bottom edge areas of the back piece a tape rule pocket is formed which includes inner side detent ridges which firmly grip and maintain a standard tape rule and its casing within such pocket.

Other objects and advantages of the invention will become apparent from the following summary and detailed descriptions of a preferred embodiment of the invention taken in conjunction with the accompanying drawing figures.

SUMMARY OF THE INVENTION

The present invention relates to a tape rule holder formed from two die cut flat pieces of heavy duty, top grain saddle leather. The back piece includes belt slots in its upper section. The front piece or pocket-forming member is configured in its flat pre-assembly form with peripheral side rivet areas and a bottom rivet area each defined by a fold line. Approximately mid-way of each side rivet area of the front piece is a "v" notch. Upon rivet assembly of the front pocket-forming piece to the back piece by flat-head rivets, with the front piece bowed outwardly to form a tape rule pocket and the "v" notches of the side rivet areas closed, the resulting tape rule pocket includes pressure dentent ridges on each inner side wall of the pocket. Upon insertion of a standard hevy duty encased tape rule into the pocket the detent side ridges grip the encased rule and maintain same within the pocket against accidental dislodgement.

BRIEF DESCRIPTION OF THE DRAWING FIGURES

DETAILED DESCRIPTION OF THE INVENTION

Figure 1:
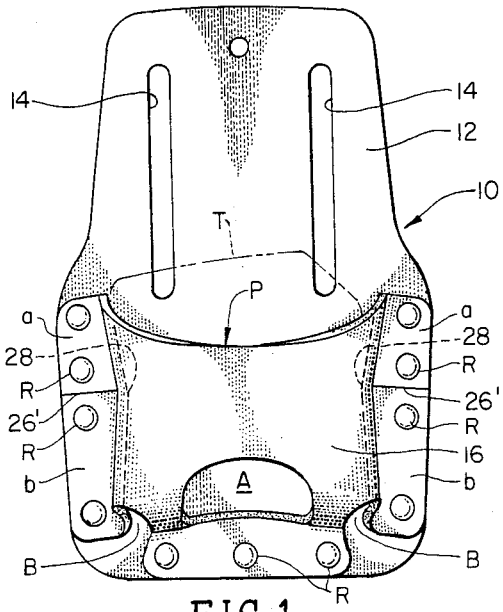
FIG. 1 is a front view of the leather tape rule holder of the invention.
Figure 2:
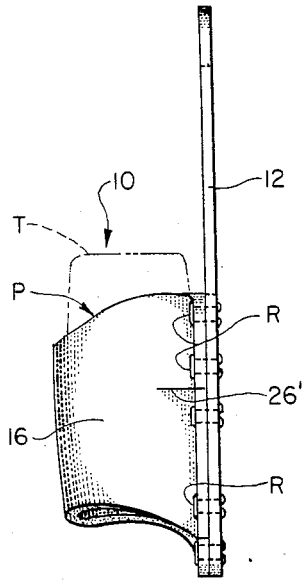
FIG. 2 is a right side view of the tape rule holder of FIG. 1.
Figure 3:
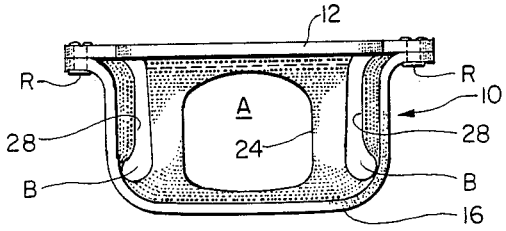
FIG. 3 is a top view of the tape rule holder of FIG. 1.

Referring now to the drawing figures, a preferred embodiment of the leather tape rule holder of the invention is illustrated in FIGS. 1–3. Numeral 10 represents in general the assembled leather tape rule holder according to the invention with its unique built-in tape rule gripping feature of the holder. The holder consists essentially of a flat leather back piece or rear wall member 12, which includes belt slots 14, and a front pocket-forming member 16 riveted in its peripheral side and bottom areas to the lower peripheral side and botto areas of the back piece 12. A tape rule of common configuration is shown in phantom outline in FIGS. 1 and 2 as item T.

Figure 4:
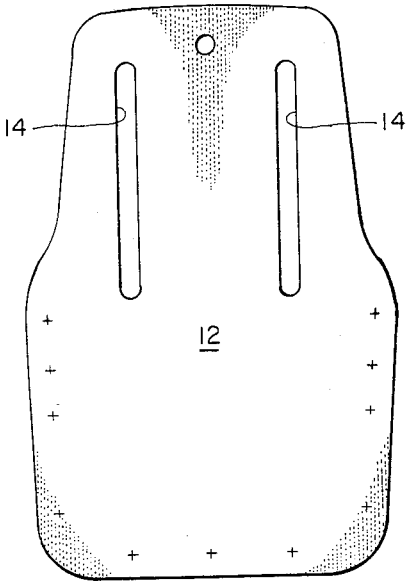
FIG. 4 is a front plan view of the leather back piece or rear component used in the construction of the tape rule holder of FIG. 1.
Figure 5:
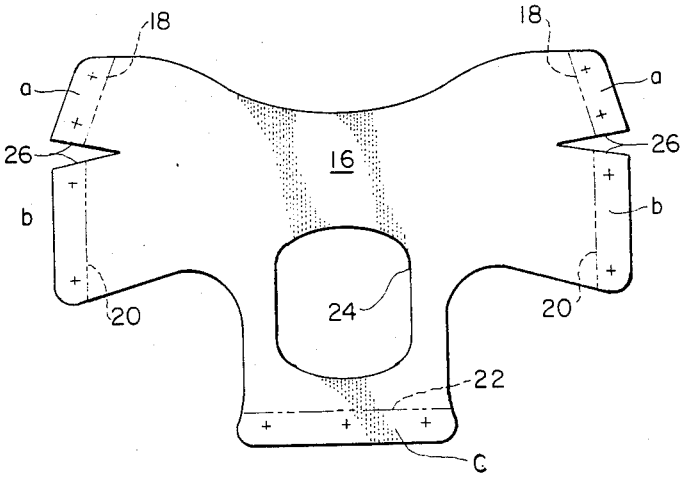
FIG. 5 is a front plan view of the front leather component used inthe construction of the tape rule holder of FIG. 1.

The full flat configuration of rear wall or back piece member 12, before its utilization in the assembly of the tape holder 10, is shown in FIG. 4. The pre-assembly flat configuration of pocket-forming member 16 is shown in FIG. 5. The peripheral side rivet areas of member 16 are designated as areas a and b defined by fold lines 18 and 20, respectively. The peripheral bottom rivet area of member 16 is designated as area c defined by bottom fold line 22. The points of placement of the leather-joining rivets are indicated for each side and bottom rivet area of pocket-forming member 16 by small + marks in such areas. The pocket-forming member 16 of tape holder 10 (as shown in FIG. 5) is peripherally configured, and is provided with a cut-out area or port 24, so that upon its rivet affixation to back piece or rear wall member 12 (as shown in FIGS. 1–3) open ports A and B are created.

It is to be particularly noted, by reference to FIG. 5, that the side periphery rivet areas a and b of the pocket-forming member 16 are each separated by a "v" notch 26. Upon rivet assembly of the pocket-forming member 16 to back piece 12 by flat-head rivets R (see FIGS. 1–3), the side "v" notches 26 are closed and form side abutment lines 26' between side rivet areas a and b of member 16 on each side of the tape rule pocket P. The matching peripheral points of rivet placement for rear wall member 12 are indicated for each side and bottom rivet area thereon by small + marks. Through the unique manner of assembly of leather pocket-forming member 16 to leather back piece 12 to form the tape rule holder 10 of the invention, the tape rule pocket P formed thereby includes a pressure detent ridge 28 on each inner side wall of the pocket. This pair of detent ridges hold the tape rule T within the pocket P without the need of a top tape rule retaining strap as provided with tape rule holders of prior design.

In the specification and drawiing figures there has been set forth a preferred embodiment of a leather tape rule holder which, in accordance with the invention, includes in its pocket configuration side detent ridges which firmly and safely maintain a tape rule within such pocket without the need for a top safety strap. Although specific terms have been employed in describing the invention, they are used in a generic and descriptive sense only and not for purposes of limitation, the scope of the invention being defined in the following claims.

What is claimed is:

1. In a leather tape rule holder of the type that consists of a back leather piece including means adapted for mounting on the belt of the user of a tape rule to be carried by said holder and a front leather piece forming a tape rule pocket comprising a front wall, side walls and a bottom wall areas of said with peripheral side wall and bottom wall projecting laterally to overlap said back piece and being riveted to the lower peripheral side edge and bottom edge areas, respectively, of said back piece, the improvement comprising the provision of a "v" notch extending across each of the peripheral side wall areas of said front piece at approximately the midpoint thereof with the "v" notch of each peripheral side wall area closed upon the riveting of said front piece to said back piece whereby there is formed on the inner side walls of said pocket pressure detent ridges which together grip a tape rule inserted into said pocket and maintain same therein against accidental dislodgement.

2. In a leather tape rule holder of the type that consists of an elongated back leather piece having belt slots i its upper portion and a front leather piece having a central portion for forming a front wall, side portions on each side of said central portion for forming side walls and a lower portion below said central portion for forming a bottom wall of a tape rule pocket of said holder with the outer peripheral edge areas of said side walls and said bottom wall of said front piece overlapping and riveted, respectively, to the lower peripheral side edge and bottom edge areas of said back piece, the improvement comprising the provision of a "v" notch extending across each of the outer peripheral edge areas of said side walls of said front piece at approximately the midpoint thereof with the "v" notch of each outer peripheral edge area of said side walls closed upon the riveting of said edge areas of the side portions of said front piece to said back piece whereby there is formed in the side walls of said pocket pressure detent ridges which together grip a tape rule inserted into said pocket and maintain same therein against accidental dislodgement.

3. In a leather tool holder of the type that consists of an elongated back leather piece having belt slots in its upper portion and a front leather piece having a central portion for forming a front wall, side portions on each side of said central portion for forming side walls and a lower portion below said central portion for forming a bottom wall of a tool pocket of said holder with the outer peripheral edge areas of said side walls and said bottom wall of said front piece overlapping and riveted, respectively, to the lower peripheral side edge and bottom edge areas of said back piece, the improvement comprising the provision of a "v" notch extending across each of the outer peripheral edge areas of said side walls of said front piece at approximately the midpont thereof with the "v" notch of each outer peripheral edge area of said side walls closed upon the riveting of said edge areas of the side portions of said front piece to said back piece whereby there is formed in the side walls of said pocket pressure detent ridges which together grip a tool inserted into said pocket and maintain same therein against accidental dislodgement.

4. A leather tool holder as claimed in claim 3 wherein the lower portion of the front leather piece which forms the bottom wall of said holder includes an open port area.

* * * * *